US008256769B2

(12) United States Patent
Takahira et al.

(10) Patent No.: US 8,256,769 B2
(45) Date of Patent: Sep. 4, 2012

(54) FEEDING DEVICE AND IMAGE FORMING APPARATUS

(75) Inventors: Masafumi Takahira, Osaka (JP); Hiroshi Fujiwara, Osaka (JP); Shigeo Nanno, Kyoto (JP); Yasuhide Ohkubo, Osaka (JP); Ippei Kimura, Osaka (JP); Mizuna Tanaka, Osaka (JP); Toshikane Nishii, Osaka (JP); Haruyuki Honda, Osaka (JP); Tomoyoshi Yamazaki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/064,893

(22) Filed: Apr. 25, 2011

(65) Prior Publication Data

US 2011/0204556 A1 Aug. 25, 2011

Related U.S. Application Data

(62) Division of application No. 12/073,941, filed on Mar. 12, 2008, now Pat. No. 7,954,814.

(30) Foreign Application Priority Data

Mar. 13, 2007 (JP) ..... 2007-064159

(51) Int. Cl.
*B65H 27/00* (2006.01)

(52) U.S. Cl. ..... 271/272; 271/188; 271/302

(58) Field of Classification Search ..... 271/225, 271/272, 301, 303, 304, 161, 188, 209; 347/104
See application file for complete search history.

(56) References Cited

U.S. PATENT DOCUMENTS 4,214,740 A 7/1980 Acquaviva
4,251,000 A * 2/1981 Templeton ..... 209/547
4,346,880 A 8/1982 Roller et al.
5,082,272 A 1/1992 Xydias et al.
5,265,864 A 11/1993 Roux et al.
5,449,164 A 9/1995 Quesnel et al.
5,485,244 A * 1/1996 Gotoda et al. ..... 399/111
5,590,872 A 1/1997 Oominami et al.
5,788,229 A 8/1998 Asami et al.

(Continued)

FOREIGN PATENT DOCUMENTS

JP 59-128154 7/1984

(Continued)

OTHER PUBLICATIONS

Applicants enclose an English Language Abstract for Japanese Patent Publication No. 63-066583 dated Mar. 25, 1988.

(Continued)

*Primary Examiner* — Michael McCullough
*Assistant Examiner* — Howard Sanders
(74) *Attorney, Agent, or Firm* — Harness, Dickey & Pierce, P.L.C.

(57) ABSTRACT

A sheet discharge roller has a contact portion in contact with a feed roller and a noncontact portion not in contact with the feed roller. The sheet discharge roller includes a kick-out unit having a projected portion and a recess portion on one end of the noncontact portion in the circumferential direction. A reverse roller also has a contact portion in contact with the feed roller and a noncontact portion not in contact with the feed roller. The reverse roller includes a large-diameter portion on its one end in a direction opposite to a direction of the kick-out unit. The large-diameter portion has a diameter larger than a diameter of the contact portion.

4 Claims, 16 Drawing Sheets

U.S. PATENT DOCUMENTS

| | | | | |
|---|---|---|---|---|
| 6,341,777 | B1 | 1/2002 | Carter | |
| 6,702,284 | B2 | 3/2004 | Sette et al. | |
| 6,769,682 | B2 | 8/2004 | Sumi et al. | |
| 6,808,171 | B2 | 10/2004 | Carter et al. | |
| 7,040,615 | B2 * | 5/2006 | Suzuki et al. | 271/188 |
| 7,090,213 | B2 | 8/2006 | Suzuki et al. | |
| 7,431,293 | B2 | 10/2008 | Carter et al. | |
| 2002/0135119 | A1 | 9/2002 | Suzuki et al. | |
| 2003/0016401 | A1 | 1/2003 | Saito | |

FOREIGN PATENT DOCUMENTS

| | | |
|---|---|---|
| JP | 04-213530 | 8/1992 |
| JP | 2619366 | 3/1997 |
| JP | 10-109794 | 4/1998 |
| JP | 11/228005 | 8/1999 |
| JP | 11-341202 | 12/1999 |
| JP | 2000-007184 | 1/2000 |
| JP | 2000-016661 | 1/2000 |
| JP | 2001-063892 | 3/2001 |
| JP | 2002-091209 | 3/2002 |
| JP | 2002-274725 | 9/2002 |
| JP | 2003-312889 | 11/2003 |
| JP | 2004-299172 | 10/2004 |
| JP | 2005-060115 | 3/2005 |
| JP | 2005/112533 | 4/2005 |
| JP | 2005-194089 | 7/2005 |
| JP | 3994060 | 8/2007 |

OTHER PUBLICATIONS

Applicants enclose an English Language Abstract for Japanese Patent Publication No. 2004-216567 dated Aug. 5, 2004.

* cited by examiner

FEEDING DEVICE AND IMAGE FORMING APPARATUS

CROSS-REFERENCE TO RELATED APPLICATIONS

This application is a divisional of U.S. application Ser. No. 12/073,941, filed Mar. 12, 2008, now U.S. Pat. No. 7,954,814 which claims priority under U.S.C. §119 to Japanese Patent Application No. 2007-064159, filed on Mar. 13, 2007 in the Japanese Patent Office, the contents of each which are hereby incorporated by reference, in their entirety.

BACKGROUND

1. Field of the Invention

Example embodiments relate to a feeding device and an image forming apparatus.

2. Description of the Related Art

An image forming apparatus capable of double-side printing usually includes a discharge unit that discharges a sheet and a switchback unit that switches back a sheet for double-side printing. If each of the discharge unit and the switchback unit is configured to function with both a feed roller group including a feed roller that feeds a sheet and a roller group including a roller rotatable along with the feed roller, the discharge unit and the switchback unit cannot be operated at the same time.

If the switchback unit is configured to function by using three roller groups including a feed roller group provided with a feed roller that feeds a sheet, a first roller group provided with a roller rotatable along with the feed roller, and a second roller group rotatable along with the feed roller being in contact with the first roller group, it is possible to discharge a sheet by the first roller group, and at the same time, to switchback a feeding direction of another sheet for double-side printing by the second roller group. Therefore, the number of sheets that can be printed per unit time increases compared with that using two roller groups of the feed roller group and the single roller group.

When performing one-side printing, a sheet with an image on one side is discharged to a sheet catch tray by the feed roller group and the first roller group. On the other hand, when performing double-side printing, a sheet with an printed image on one side is conveyed toward the sheet catch tray by the feed roller group and the second roller group, and by reversing rotational direction of the feed roller group before discharging the sheet, the sheet with the printed image on one side is switched back toward a double-side printing path.

At the same time, the feed roller group and the first roller group feed the sheet with a printed image on both sides toward the sheet catch tray to discharge the sheet. At this time, a sheet guide is not usually arranged in a direction of the sheet catch tray in the second roller group so that a discharged sheet can be taken out easily. With this configuration, the sheet being conveyed toward the double-side printing path and the sheet being discharged come closer to each other.

An image forming apparatus for realizing the above functions is disclosed in Japanese Patent Application Laid-Open No. 2005-112533 and Japanese Patent Application Laid-Open No. 2005-194089. The image forming apparatus includes a driving source which can switch rotational direction of the feed roller group between forward and backward and a switching guide that switches the sheet feeding direction toward a switchback feeding path for double-side printing.

Furthermore, some image forming apparatuses perform a switching operation using a plurality of gears, while an oscillating gear that oscillates with the switching operation is provided between a driving unit and the feed roller. The sheet feeding direction is switched by oscillating the oscillating gear at each switching operation.

Moreover, other image forming apparatuses include the first roller group having a projected portion in an annular manner at one end of the roller in the first roller group to corrugate the sheet to be discharged to impart stiffness on the sheet. Therefore, it is possible to prevent drooping-down of the discharged sheet near the first roller group and its overlapping and rubbing with the sheet catch tray and already-discharged sheet. Thus, the sheet being fed to the sheet discharge tray does not rub, and thereby damage or stain on the image formed on the sheet can be prevented. Furthermore, a recess portion is provided with a projected portion on the end of the first roller to have a projection and recess shape on a circumference of the first roller. By hooking a rear end of the sheet by the projected portion and rotating the first roller group, the rear end of the sheet is fed out with momentum so that the discharged sheet does not drop or bend before the sheet catch tray or interfere with a subsequent discharged sheet.

In a feeding device that feeds a sheet in a first direction by a feed roller group provided with a plurality of feed rollers and a first roller group rotated along with the feed rollers, and also feeds another sheet in a second direction opposite to the first direction by a second roller group rotated along with the feed roller, the following problems often occur. When the sheets are conveyed in the first direction and the second direction at the same time and if the sheets come close to each other, the sheet discharged from the feed roller group and the first roller group hardly droops because it is fed with stiffness, but the sheet fed toward the sheet catch tray from the feed roller group and the second roller group easily droops thereby being overlapped and rubbed with the sheet discharged from the feed roller group and the first roller group. Thus, an image on the sheet is rubbed, damaged or stained.

SUMMARY

It is an object of the example embodiments to at least partially solve the problems in the conventional technology.

According to an aspect of the example embodiments, there is provided a feeding device that includes a feed roller group including at least two feed rollers rotatable around an axis perpendicular to a sheet feeding direction; a first roller group including at least two first rollers rotatable along with the feed rollers, and operative to convey the sheet with the feed roller to a first direction; and a second roller group including at least two second rollers rotatable along with the feed rollers, and operative to convey the sheet with the feed rollers to a second direction opposite to the first direction, wherein at least one of the first rollers includes a first asymmetric roller having a first contact region that is in contact with the feed roller and a first noncontact region that is not in contact with the feed roller, the first noncontact region being arranged at an end of the first roller in a first axial direction of a rotating shaft of the feed rollers and having a diameter larger than a diameter of the first contact region, and at least one of the second rollers includes a second asymmetric roller having a second contact region that is in contact with the feed roller and a second noncontact region that is not in contact with the feed roller, the second noncontact region being arranged at an end of the second roller in a second axial direction opposite to the first axial direction and having a diameter larger than a diameter of the second contact region.

According to another aspect of example embodiments, there is provided an image forming apparatus that includes a feeding device including a feed roller group including at least two feed rollers rotatable around an axis perpendicular to a sheet feeding direction; a first roller group including at least two first rollers rotatable along with the feed rollers, and operative to convey the sheet with the feed roller to a first direction; and a second roller group including at least two second rollers rotatable along with the feed rollers, and operative to convey the sheet with the feed rollers to a second direction opposite to the first direction, wherein at least one of the first rollers includes a first asymmetric roller having a first contact region that is in contact with the feed roller and a first noncontact region that is not in contact with the feed roller, the first noncontact region being arranged at an end of the first roller in a first axial direction of a rotating shaft of the feed rollers and having a diameter larger than a diameter of the first contact region, and at least one of the second rollers includes a second asymmetric roller having a second contact region that is in contact with the feed roller and a second noncontact region that is not in contact with the feed roller, the second noncontact region being arranged at an end of the second roller in a second axial direction opposite to the first axial direction and having a diameter larger than a diameter of the second contact region; a feeding unit that conveys a sheet having a surface where an image is printable; and an image forming unit that prints an image on the sheet, wherein the first roller serves as a sheet discharge roller, a portion where the feed roller is in contact with the first roller serves as a sheet discharge unit, the second roller serves as a reverse roller, and a portion where the feed roller is in contact with the second roller serves as a reversing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF EXAMPLE EMBODIMENTS

Exemplary embodiments of the present invention are explained in detail below with reference to the accompanying drawings.

Figure 1:
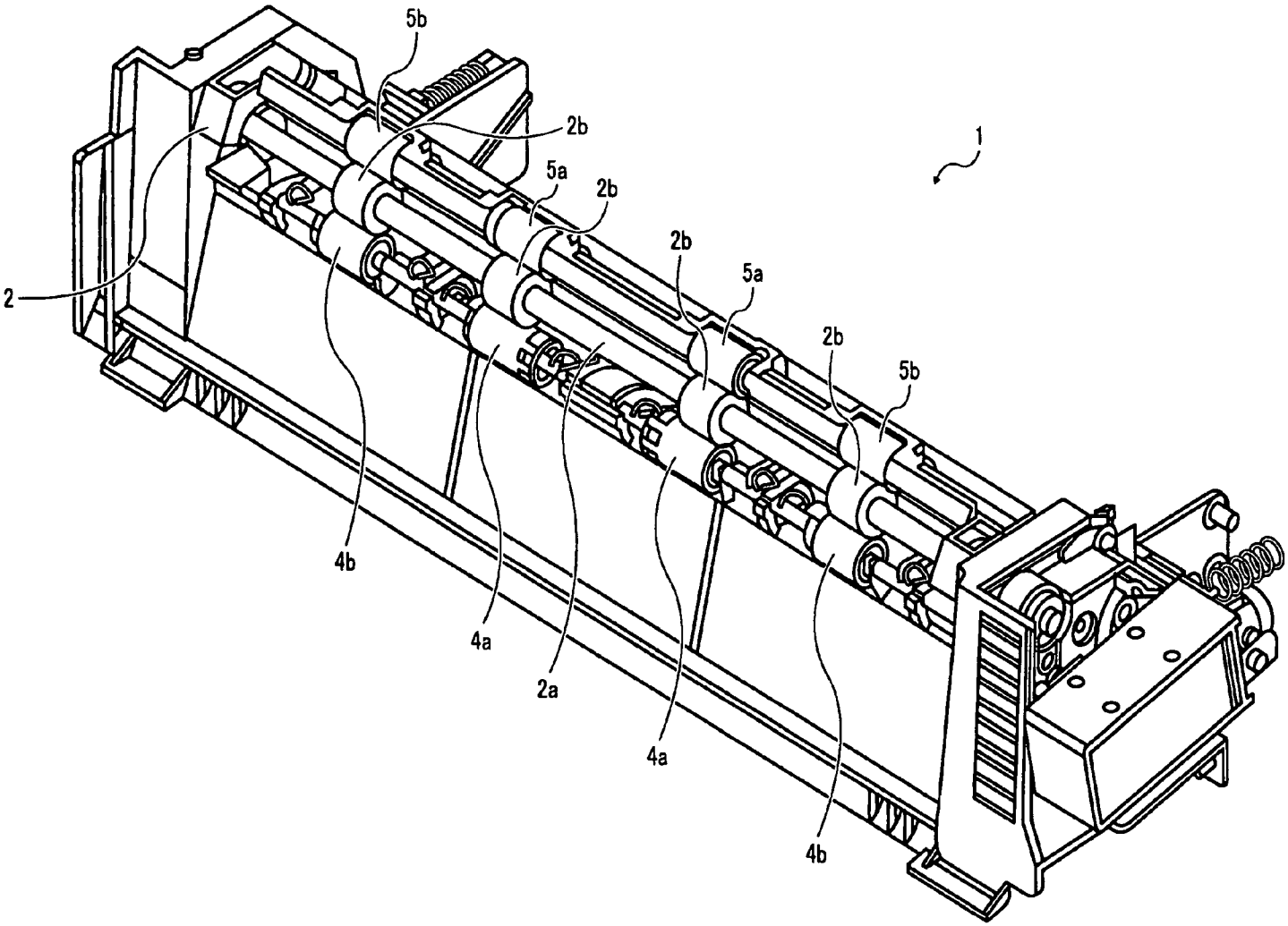
FIGS. 1 and 2 are perspective views of a sheet discharge-reverse device according to a first embodiment of the present invention.
Figure 2:
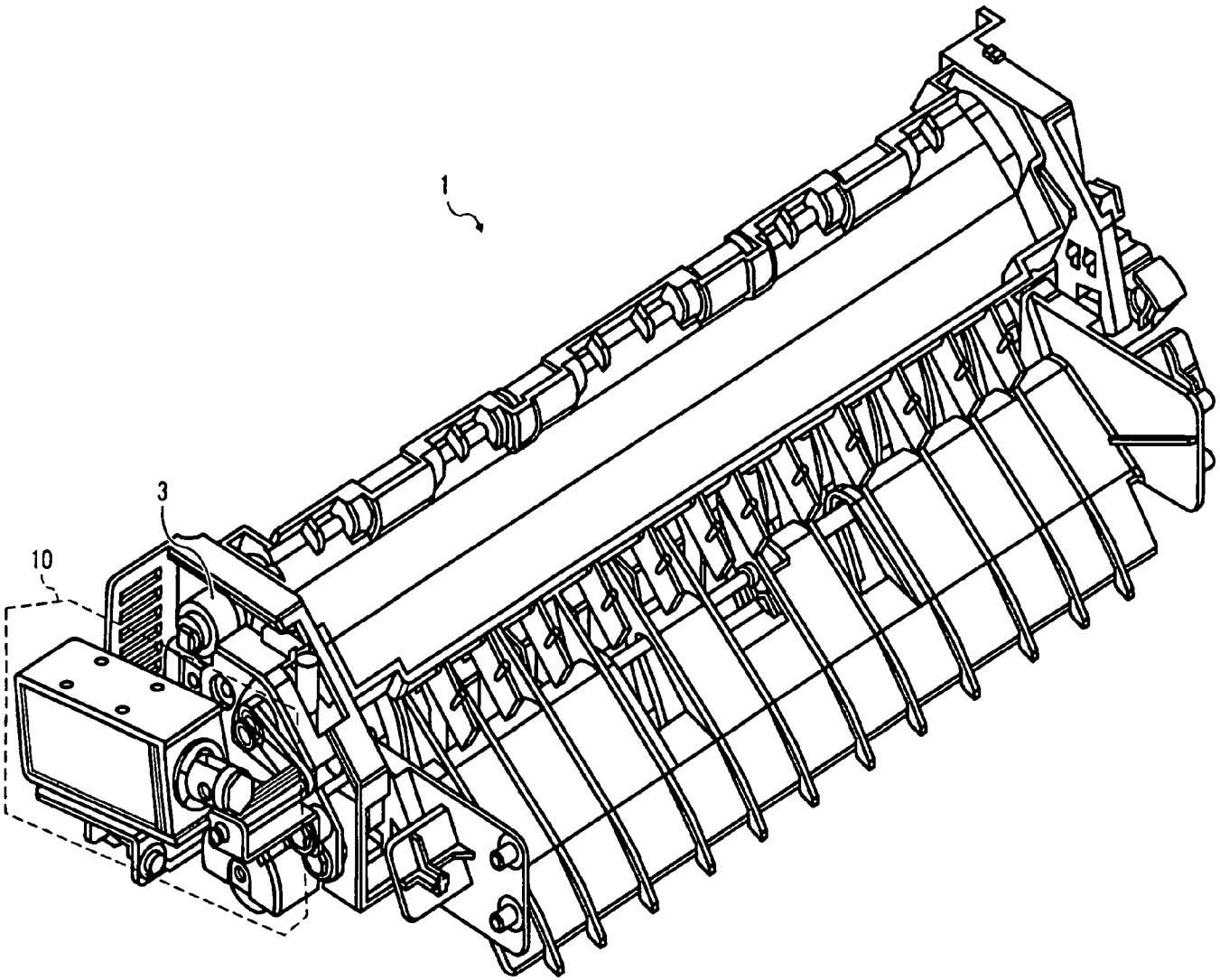
Figure 3:
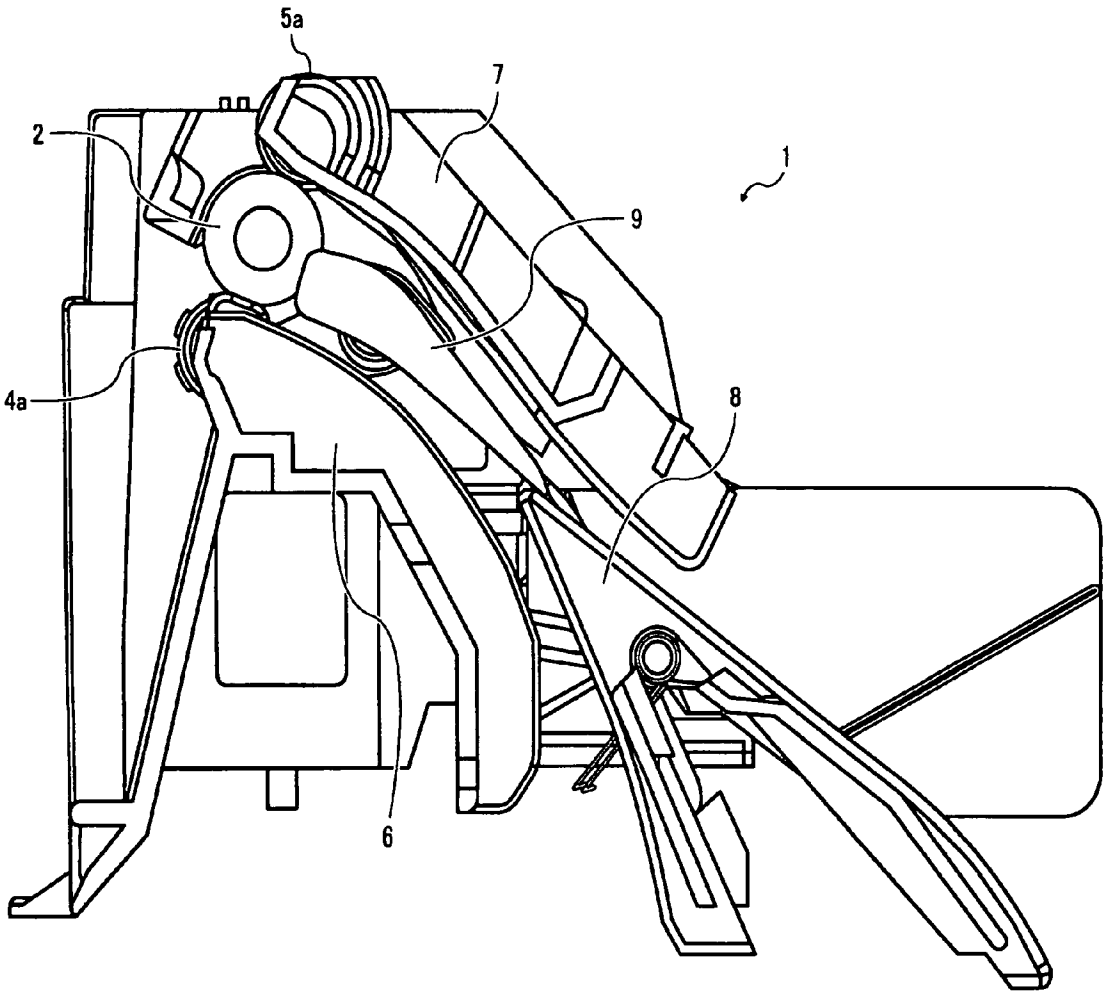
FIG. 3 is a side view of the sheet discharge-revere device shown in FIG. 1.

FIGS. 1 to 3 are schematic diagrams of a sheet discharge-reverse device 1 according to a first embodiment of the present invention.

The sheet discharge-reverse device 1 has a feed roller group 2, a driving source 3, sheet discharge rollers 4*a*, 4*b*, reverse rollers 5*a*, 5*b*, guide members 6, 7, 8, a switching guide member 9, and a switching control mechanism 10.

The driving source 3 drives the feed roller group 2. The sheet discharge rollers 4*a*, 4*b* are driven and rotated by the feed roller group 2, and conveys a sheet to a sheet catch tray (not shown). The reverse rollers 5*a*, 5*b* are driven and rotated by the feed roller group 2, and reverse their rotation direction in the middle of feeding. The guide member 6 guides the sheet to a contact portion between the feed roller group 2 and the sheet discharge rollers 4*a*, 4*b*. The guide member 7 guides the sheet to a contact portion between the feed roller group 2 and the reverse rollers 5*a*, 5*b*. The guide member 8 guides the sheet reversed by the reverse rollers 5*a*, 5*b* to a reverse feeding unit (not shown). The switching guide member 9 switches a direction of sheet feeding to the contact portion between the feed roller group 2 and the sheet discharge rollers 4*a*, 4*b* or to the contact portion between the feed roller group 2 and the reverse rollers 5*a*, 5*b*. The switching control mechanism 10 controls a state of the switching guide member 9.

The feed roller group 2 includes a rotating shaft 2*a* and feed rollers 2*b*. The feed roller 2*b* is made of rubber so that a friction force necessary for feeding sheet is generated between the sheet and the feed roller 2*b* when the sheet is supplied to the contact portion between the feed roller 2*b* and the sheet discharge rollers 4*a*, 4*b* and to the contact portion between the feed roller 2*b* and the reverse rollers 5*a*, 5*b*.

Figure 4:
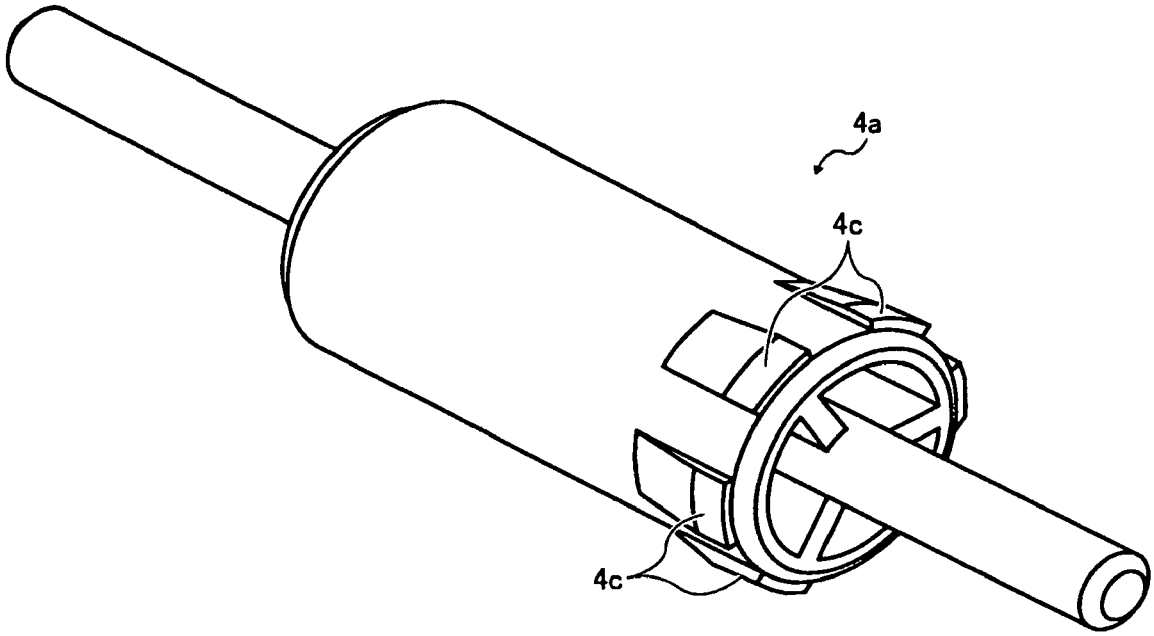
FIG. 4 is a perspective view of a sheet discharge roller of the sheet discharge-reverse device shown in FIG. 1.

FIG. 4 is a perspective view of the sheet discharge roller 4*a*. The sheet discharge roller 4*a* has a contact portion in contact with the feed roller 2*b* and a noncontact portion not in contact with the feed roller 2*b*. A kick-out member 4*c* is provided on one end of the noncontact portion. The kick-out member 4*c* is formed of a projected portion and a recess portion in the circumferential direction of the sheet discharge roller 4*a*. With this configuration, a sheet to be discharged is corrugated to have stiffness to prevent a situation where the sheet is delivered onto the sheet catch tray while the sheet is overlapped and rubbed with the sheet catch tray or discharged sheets thereby causing damage or stain on an image on the sheet.

Moreover, by hooking the sheet rear end by the projected portion and then rotating the sheet discharge roller 4*a*, the sheet rear end is fed out with momentum so that the sheet does not drop or is bended before the sheet reaches the sheet catch tray and does not interfere with a subsequently-discharged sheet.

Figure 5:
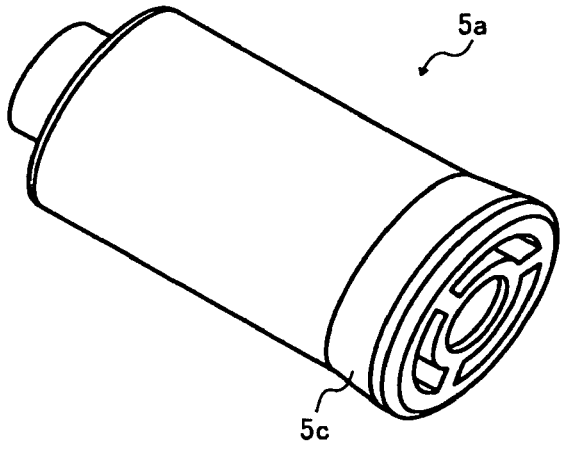
FIG. 5 is a perspective view of a reverse roller of the sheet discharge-reverse device shown in FIG. 1.

FIG. 5 is a perspective view of the reverse roller 5*a*. The reverse roller 5*a* has a contact portion in contact with the feed roller 2*b* and a noncontact portion not in contact with the feed roller 2*b*. A large-diameter portion 5*c* is provided on one end of the contact portion so that a diameter of an end in a direction opposite to a direction where the kick-out member 4*c* is located becomes larger than a diameter of the contact portion.

By providing the noncontact portions at both ends of the sheet discharge rollers 4*a*, 4*b* and the reverse rollers 5*a*, 5*b*, respectively, and by setting the same amount of force to bring the sheet discharge rollers 4*a*, 4*b* and the reverse rollers 5*a*, 5*b* into contact with the feed roller 2*b*, a feeding force of the sheet fed by the sheet discharge roller 4 can be made equal to the feeding force of the sheet fed by the reverse roller 5. In other words, the noncontact portion of the sheet discharge rollers 4*a*, 4*b* and the noncontact portion of the reverse rollers 5*a*, 5*b* are formed in a same range.

The sheet discharge rollers 4*a*, 4*b* and the reverse rollers 5*a*, 5*b* are made of a material with sliding performance higher than those disclosed in the conventional technologies. Therefore, friction force and sliding noise can be reduced at a sliding portion (not shown) between the sheet discharge rollers 4*a*, 4*b*, the reverse rollers 5*a*, 5*b* and supporting members (not shown) of the sheet discharge rollers 4*a*, 4*b* and the reverse rollers 5*a*, 5*b*.

Figure 6:
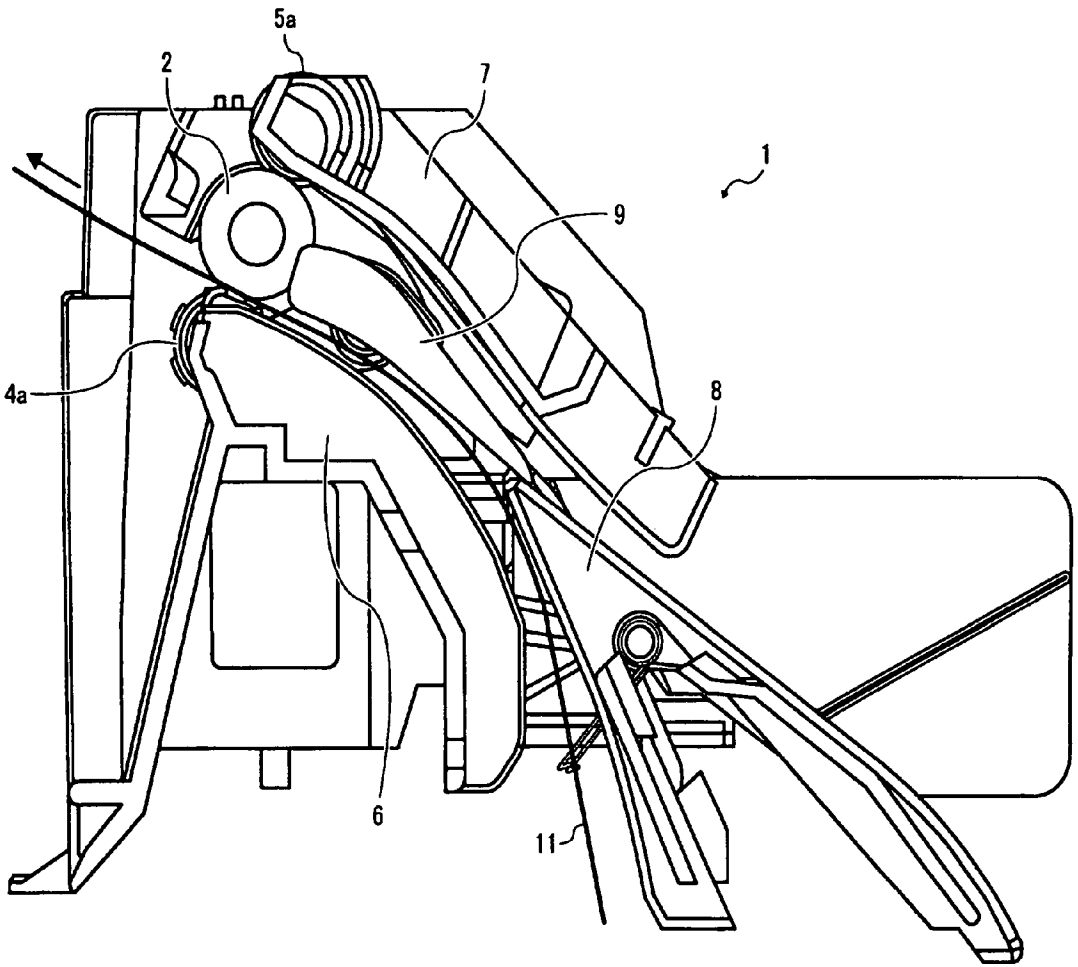
FIG. 6 is a schematic diagram for explaining how a sheet is fed by the sheet discharge roller of the sheet discharge-reverse device shown in FIG. 1.

As shown in FIG. 6, when a sheet 11 fed to the sheet discharge-reverse device 1 is delivered to the sheet catch tray, the sheet 11 is conveyed by the switching guide member 9 to the side where the feed roller group 2 is in contact with the sheet discharge rollers 4*a*, 4*b*, and the feed roller group 2 is rotated forward.

Figure 7:
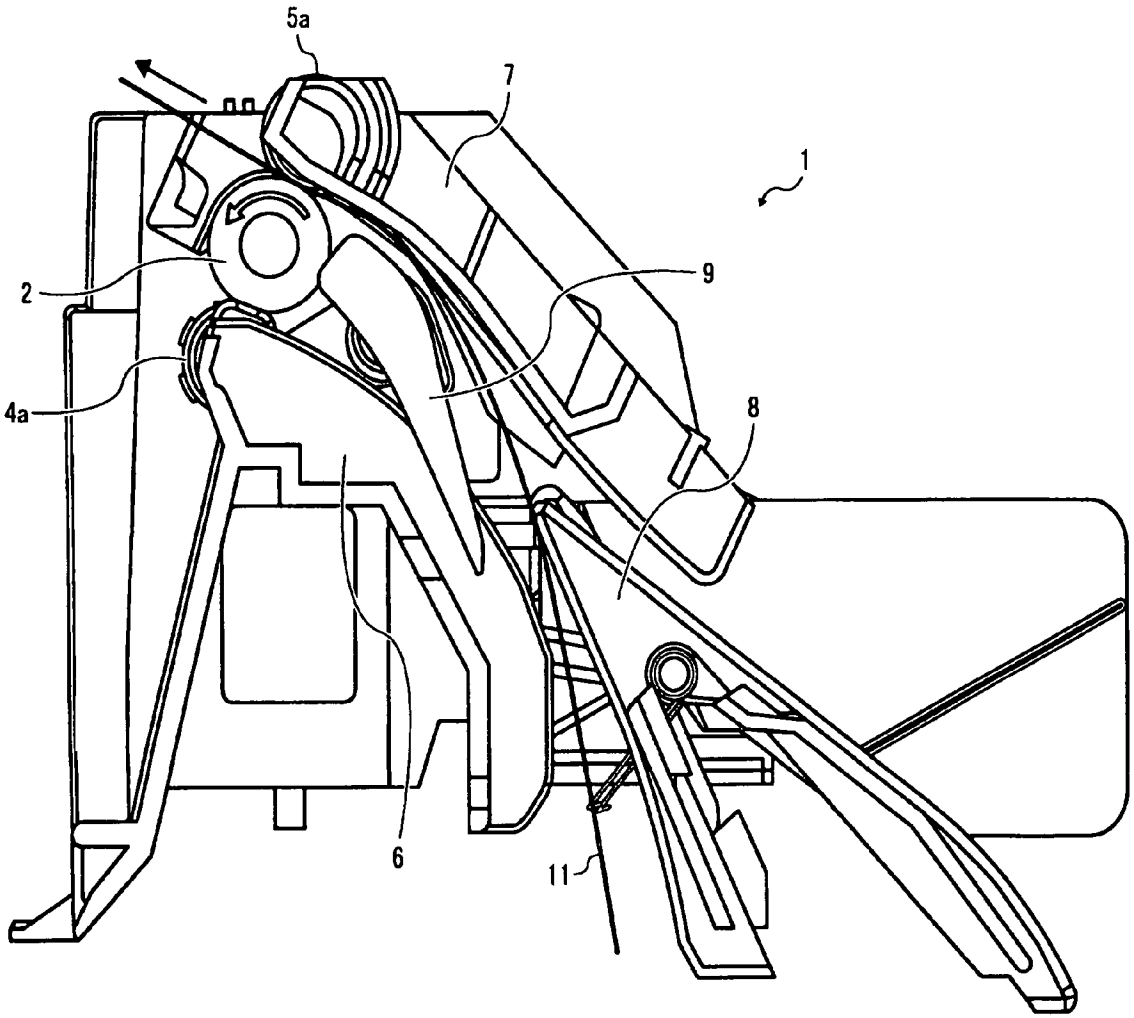
FIG. 7 is a schematic diagram for explaining how a sheet is fed by the reverse roller of the sheet discharge-reverse device shown in FIG. 1.

As shown in FIG. 7, when the sheet 11 is to be reversed and fed toward the guide member 8, the sheet 11 is conveyed by the switching guide member 9 to the side where the feed roller group 2 is in contact with the reverse rollers 5*a*, 5*b*. Then, the feed roller group 2 is rotated in a direction opposite to a direction for delivering the sheet 11 to the sheet catch tray until the sheet 11 is conveyed to the middle of a sheet catch tray side. The switching guide member 9 is switched when the sheet rear end exceeds the switching guide member 9, and the feed roller group 2 is then rotated forward to reverse a sheet feeding direction to convey the sheet 11 toward the guide member 8. At this reversing and feeding, by feeding a subsequent sheet to the sheet discharge-reverse device 1, the subsequent sheet is fed to the contact portion between the feed roller group 2 and the sheet discharge rollers 4*a*, 4*b*. Thus, the sheets can be conveyed in the reverse direction and toward the sheet catch tray at the same time.

Figure 8:
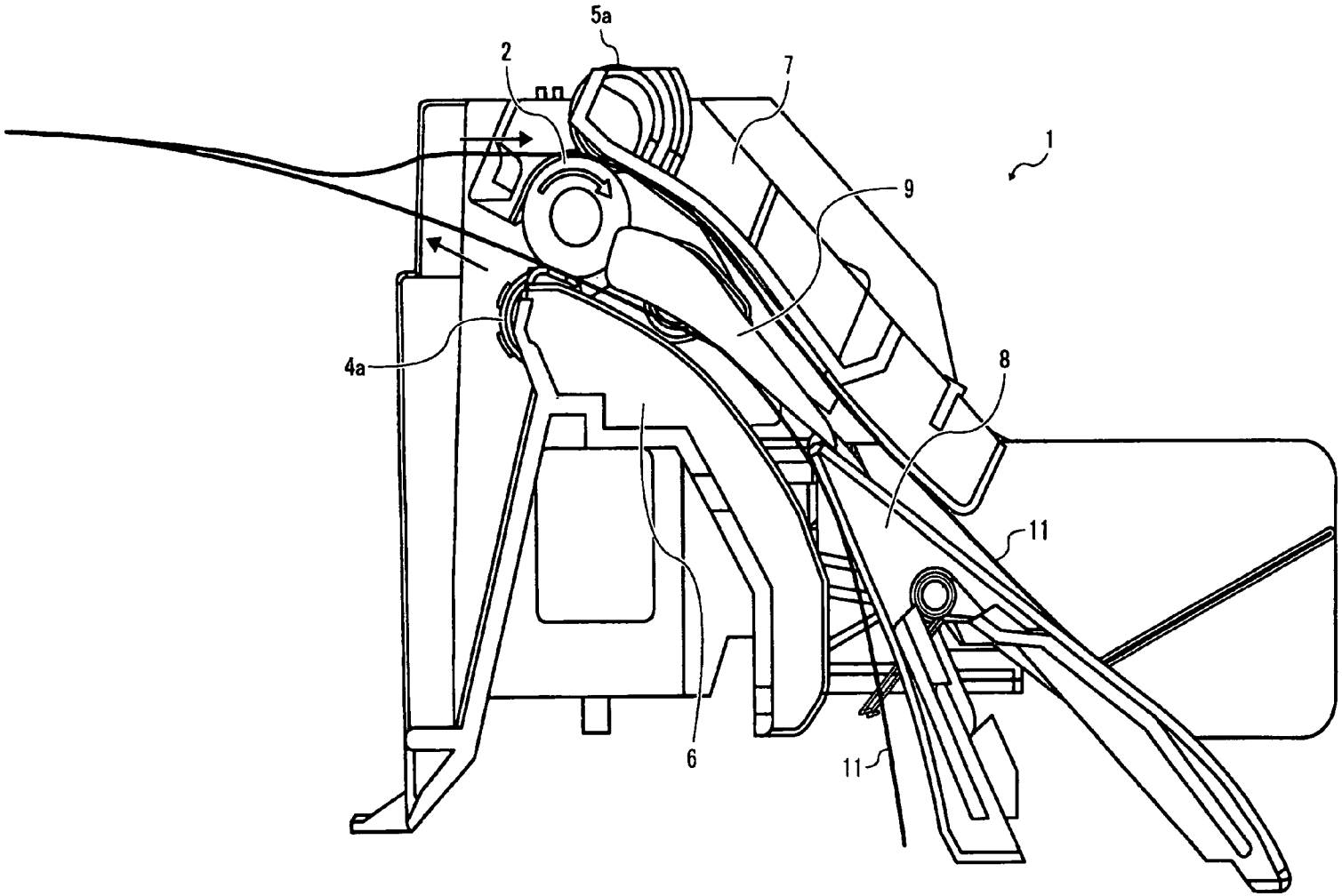
FIGS. 8 and 9 are schematic diagrams for explaining how a sheet is fed in reverse feeding and another sheet is conveyed to a sheet discharge tray at the same time.
Figure 9:
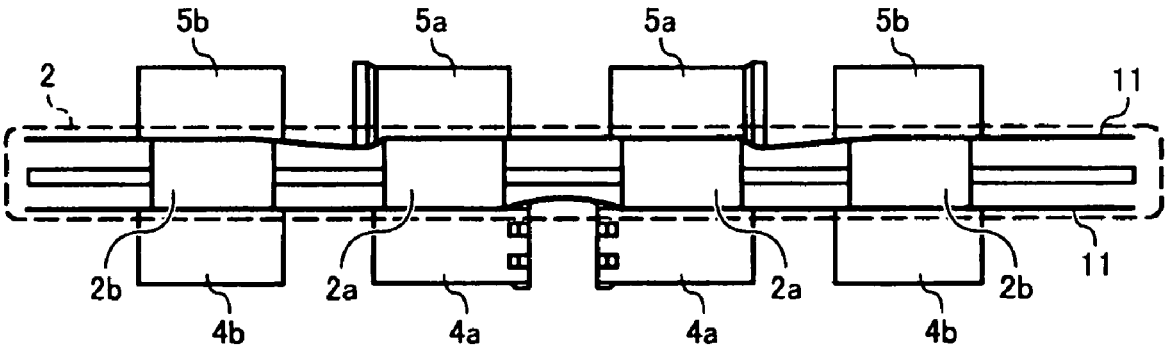

As shown in FIG. 8, the sheet conveyed for the reverse feeding and the sheet delivered to the sheet catch tray are brought close to each other on the sheet catch tray side of the feed roller group 2. However, the sheet conveyed in the reverse feeding the and sheet delivered to the sheet catch tray are corrugated by the sheet discharge roller 4*a* and the reverse roller 5*a* in a direction perpendicular to a sheet feeding direction to give stiffness to the sheet. Furthermore, as shown in FIG. 9, because the kick-out member 4*c* and the large-diameter portion 5*c* are arranged with the contact portions of the sheet discharge roller 4*a* and the reverse roller 5*a*, the sheet delivered to the sheet catch tray and the sheet conveyed in the reverse feeding are corrugated in a direction perpendicular to the sheet feeding direction at each different position.

As described above, the sheet discharge-reverse device according to the first embodiment can prevent damage or stain on the image surface when the sheet fed in the reverse feeding and the sheet delivered to the sheet catch tray at the same time. Even if the feed roller group with a small diameter is used when feeding the sheets are in the opposite directions at the same time, the sheet can be prevented from being contacted by the feed roller group. Thus, the apparatus can be downsized.

An image forming apparatus according to a second embodiment of the present invention is described below.

When a sheet with stiffness passes through a joint portion of a sheet feed guide in a curved feeding path, a sheet rear end hits the sheet feed guide surface with momentum, causing noise. The image forming apparatus according to the second embodiment can resolve such a problem.

Figure 10:
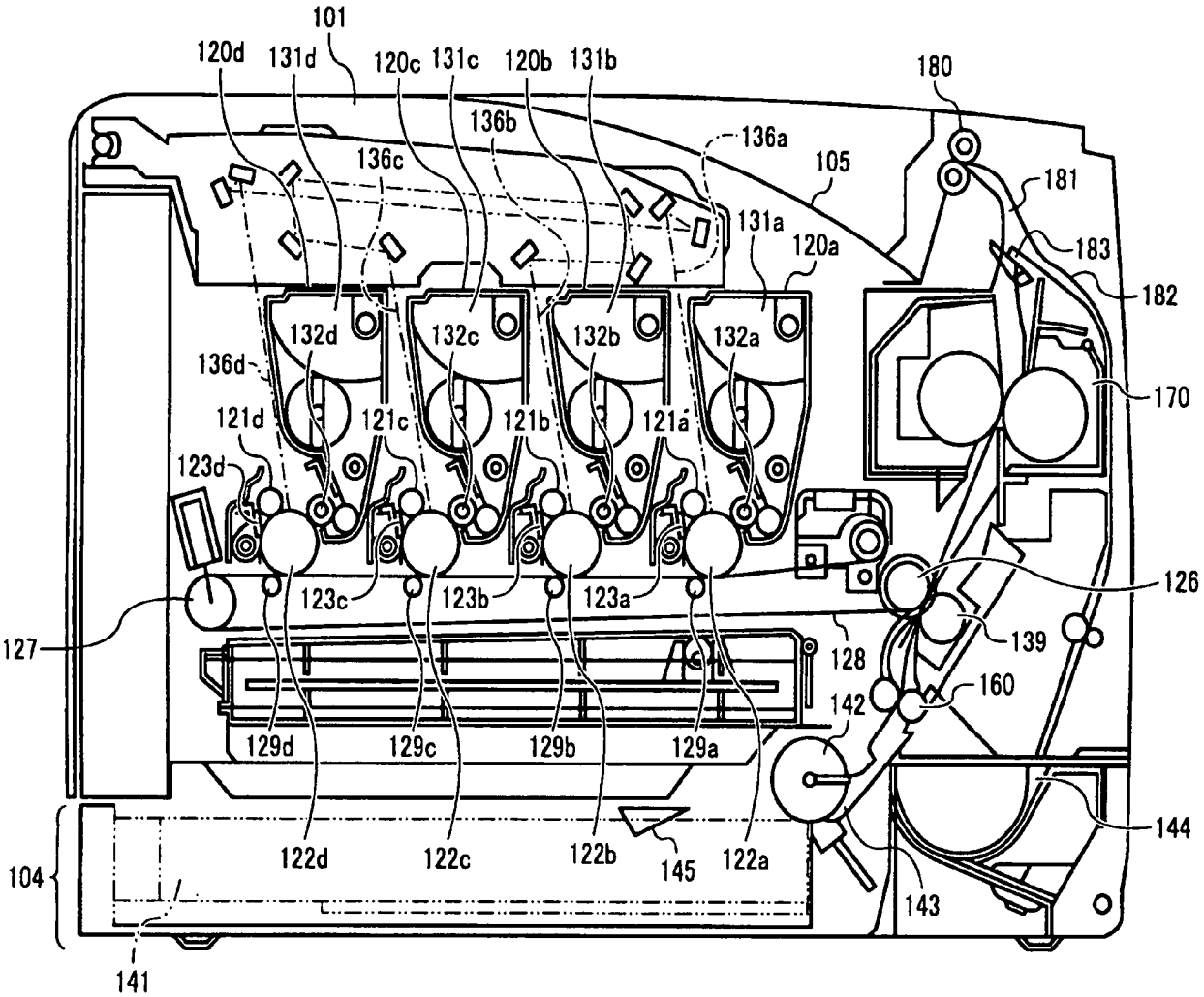
FIG. 10 is a schematic diagram of an image forming apparatus according to a second embodiment of the present invention.

FIG. 10 is a schematic diagram of the image forming apparatus according to the second embodiment. The image forming apparatus is a color image forming apparatus having four image forming units in which a single developing device is arranged on a circumference of an image carrier, and the developing device and an image carrier unit are attached to the image forming apparatus main body.

The four image forming units are arranged substantially at the center of the color image forming apparatus, and a sheet feed unit 104 is arranged below the image forming units. A sheet discharge-storage unit 105 is formed above the image forming units, and discharges from and stores therein a recording sheet with an image formed.

The sheet feed unit 104 has a stacking unit 141 for accommodating unused recording sheets. The stacking unit 141 is arranged detachably in the lateral direction, and when the stacking unit 141 is detached, a sheet feed roller 142, a recording sheet detecting unit 145 and the like are remained in the apparatus main body. The sheet detecting unit 145 is preferably located between a recording paper fixing unit and a recording paper discharge unit. The recording paper detecting unit is preferably located near a merged path of a path between the recording paper fixing unit and the recording paper discharge unit and a recording paper reversing path. The recording paper is preferably discharged from the front of the apparatus to the rear of the apparatus, and the recording paper detecting unit is more preferably located on the side opposite the image surface.

In the sheet feed unit 104, the recording sheet is separated by the sheet feed roller 142 and a friction pad 143 one by one and fed to a registration roller 160. At this state, the tip end of the recording sheet is abutted to the registration roller 160, thereby the tip ends are aligned. The registration roller 160 is controlled so that paper feeding is temporarily stopped and rotation is stopped at timing when a positional relation between a toner image of an intermediate transfer belt 128 and the sheet tip end becomes predetermined positions.

Four developing units 131 (131*a*, 131*b*, 131*c*, 131*d*) accommodating toners with different colors as developer and image carrier drums 122 (122*a*, 122*b*, 122*c*, 122*d*) arranged in combination with the developing units are provided. Around the image carrier drums 122, cleaning blades 123 (123*a*, 123*b*, 123*c*, 123*d*) for scraping remaining toner after primary transfer and charging rollers 121 (121*a*, 121*b*, 121*c*, 121*d*) in contact with image carrier drums 22 are provided. Image carrier units (image forming units) 120 (120*a*, 120*b*, 120*c*, 120*d*) includes the developing unit 131, the image carrier drums 122, the cleaning blades 123, and the charging rollers 121. A housing of the image carrier units 120 is configured to incorporate the developing units (not shown).

An intermediate transfer unit including the intermediate transfer belt 128 extended around a driving roller 126, a driven roller 127, and primary transfer rollers 129 (129*a*, 129*b*, 129*c*, 129*d*) for cyclic movement is provided.

To a core metal of developing rollers 132 (132*a*, 132*b*, 132*c*, 132*d*) of each of the developing units 131, a bias voltage with a negative potential in which alternating-current (AC) and direct-current (DC) are superimposed is applied from a bias power source (not shown). To each of the charting rollers 121, a bias voltage with a DC negative potential is applied from another bias power source (not shown). The image carrier unit 120*a* to 120*d* are includes the image carrier drums 122 combined with the developing units 131, the cleaning blades 123 in contact with the image carrier drums 122, and the charging rollers 121, and the image carrier unit 120*a* forming a first image forming unit, the image carrier unit 120*b* forming a second image forming unit, the image carrier unit 120*c* forming a third image forming unit, and the image carrier unit 120*d* forming a fourth image forming unit. The cleaning blade 123*a* cleans toner stain remaining on the circumferential face of the image carrier drum 122*a*. The charging roller 121*a* charges the circumferential face of the cleaned image carrier drum 122*a* with a uniform high potential for initialization. Then, a laser beam 136*a* is irradiated to the image carrier drum 122*a* of the image forming unit 120*a*. As a result, the circumferential face of the image carrier drum 122*a* charged with the uniform high potential is selectively exposed based on image data, so that an electrostatic latent image made up by a low potential unit with a potential lowered by the exposure and a high potential unit by the initialization is formed. This operation is also carried out for the image carrier units 120*b* to 120*d* using laser beam 136*b* to 136*d*, respectively.

The developing unit 131*a* transfers the toner to the low potential unit (or high potential unit) in the electrostatic latent image to form (develop) a toner image. The image carrier drum 122*a* rotates and feeds the toner image and transfers the toner image onto the intermediate transfer belt 128.

The image carrier unit 120*b* is operated along with the timing when the toner image on the intermediate transfer belt 128 comes to the contact portion with the image carrier drum 122*b*, the developing unit 131 images (develops) the static latent image on the image carrier drum 122*b*, and the image carrier drum 122*b* rotates and superimposes the toner image onto the toner image on the intermediate transfer belt 128. The similar operation is also carried out for the image carrier unit 120*c* and the image carrier unit 120*d*.

A quadruple toner image is conveyed by the above operation, and the toner image is transferred on a recording sheet (not shown) by a secondary transfer roller 139.

The toner image is then fixed on the recording sheet by a fixing device 170, and in the case of one-side recording, the recording sheet is discharged by a discharge device 180 to the sheet discharge-storage unit 105 formed on the upper face of an apparatus main body 101 and stacked.

In the case of double-side recording, when the rear end of the recording sheet with which image formation on the first surface is finished has passed a switching branch point 181, a feeding direction of the discharge device 180, which is a reversing unit, is reversed so that the tip end and the rear end of the recording sheet are switched and fed to a double-side feed path 182. Then, the recording sheet is fed to the registration roller 160 again through a sheet re-feed path 144 provided on a rear side of the sheet feed unit 104, a toner image on the second surface of the recording sheet is transferred by the secondary transfer roller 139 and fixed by the fixing device 170, and then, the recording sheet is discharged by the discharge device 180 to the sheet discharge-storage unit 105.

Figure 11:
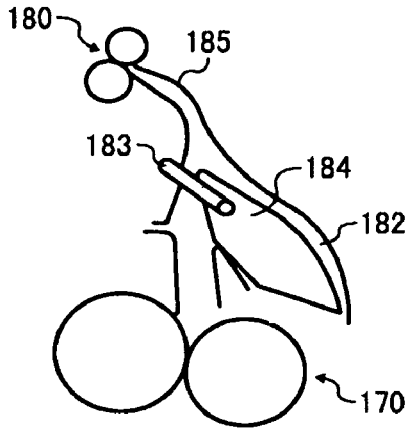
FIGS. 11 to 13 are schematic diagrams of a sheet discharge-reverse mechanism of the image forming apparatus shown in FIG. 10.
Figure 13:
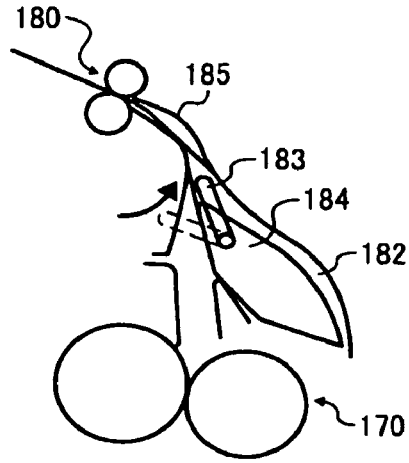

In the configuration shown in FIGS. 11 and 13, after the toner image is fixed by the fixing device 170, the rear end of the recording sheet hits a filler unit 183 from an upstream guide 184 and then, hits a downstream guide 185 from the filler unit 183. The filler unit 183 is stopped by a rotation regulating unit (not shown) between the upstream guide 184 and the downstream guide 185. A difference in level between the upstream guide 184 and a paper feed face of the filler unit 183 is set at 5 millimeters or less. A difference in level between the downstream guide 185 and the paper feed face of the filler unit 183 is also set at 5 millimeters or less.

The filler unit 183 is made longer than the tip end of the upstream guide 184. The filler unit 183 has a rotation fulcrum receiving portion (not shown) at the upstream guide 184, and the upstream guide 184 is capable of oscillation by an urging device (not shown). The filler unit 183 can be made of an elastic member such as rubber or spring and can be provided in plural.

Figure 12:
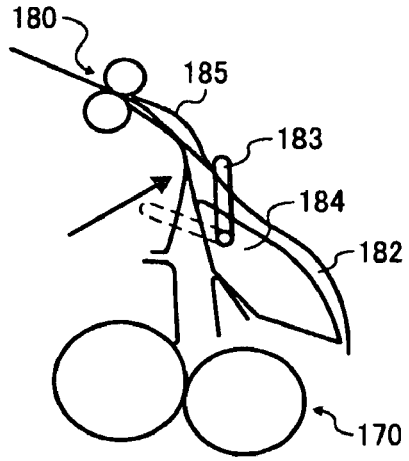

In the configuration shown in FIG. 12, an impact by the recording sheet rear end hitting the downstream guide 185 with momentum when the sheet with stiffness is passed is dispersed from the upstream guide 184 to the filler unit 183, the downstream guide 185, and the filler unit 183 so that occurrence of a noise can be prevented. By enabling the upstream guide 184 to oscillate, the impact of hitting with momentum can be absorbed by the upstream guide 184, and thereby the impact noise can be further reduced. The recording sheet detecting unit (not shown) is arranged on the side opposite to the image surface so that image blur caused by the filler unit 183 can be prevented.

A third embodiment of the present invention is described below.

In development of an image forming apparatus, it is preferable to have a stable sheet feeding function. It is also preferable to reduce cost of the apparatus to provide a less expensive apparatus. Furthermore, it is preferable to downsize the apparatus. In order to achieve such an image forming apparatus, it is effective to integrate various units to reduce the number of units.

Thus, it is effective to integrate guide members that feed a sheet with other units as much as possible and to form a guide surface in a rib shape.

Also, from a functional viewpoint, a contact area between a sheet and the guide member is reduced by employing the rib shape. Therefore, a resistance received from the guide members can be reduced, and stable feeding with smaller feeding force can be achieved.

However, depending on arrangement of the ribs, a part of a sheet might enter between the ribs and cause jamming. Positions of feed members such as a roller that feeds a sheet are also important. By devising their positional relations, preferable feeding performance can be ensured.

Figure 14:
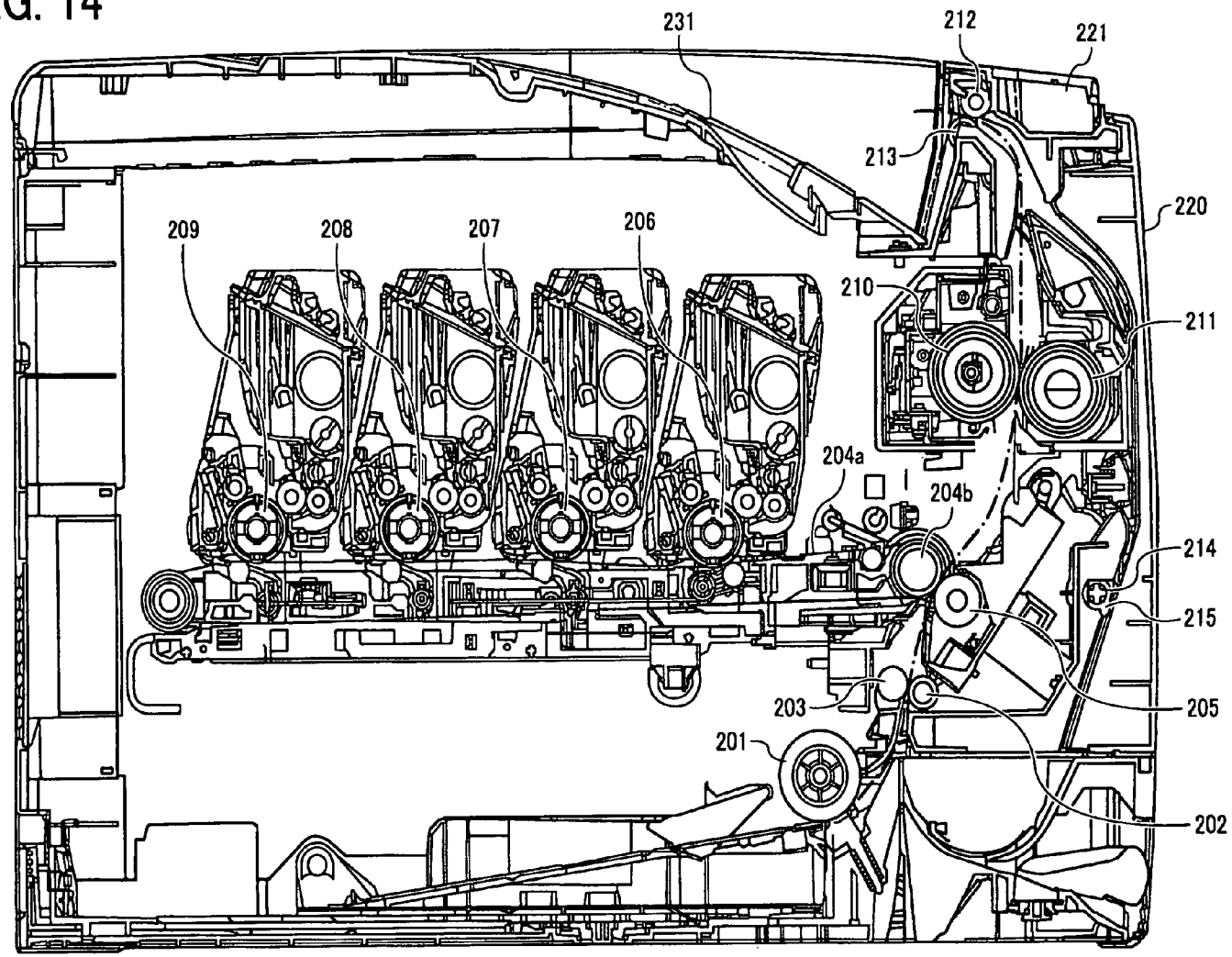
FIG. 14 is a schematic diagram of an image forming apparatus according to a third embodiment of the present invention.

FIG. 14 is a schematic diagram of an image forming apparatus according to the third embodiment. A one-dot chain line in the figure indicates a feeding path for a sheet. The sheet is separated by a sheet feed roller 201 one by one from a bulk of sheets and fed to a transfer driving roller 204*b*, a driven roller 205 through a registration driving roller 202, and a driven roller 203. An image is formed on an intermediate transfer belt 204*a* from photoreceptors 206 to 209, the image is transferred onto the sheet by the pair of the transfer driving roller 204*b* and the driven roller 205, the image is heated and fixed by a pair of fixing rollers 210, 211, and the sheet is discharged by a pair of sheet discharge rollers 212, 213 to a sheet catch tray 231. For the double-side printing, when the sheet rear end reaches the sheet discharge roller pair 212, 213, the sheet is reversed, passes inside an opening-closing cover 220 and is fed by a double-side roller pair 214, 215 to a pair of the registration driving roller 202 and the driven roller 203 and fed to the sheet catch tray 231 through a pair of the transfer driving roller 204*b* and the driven roller 205, the fixing roller pair 210, 211, and the sheet discharge roller pair 212, 213.

Figure 15:
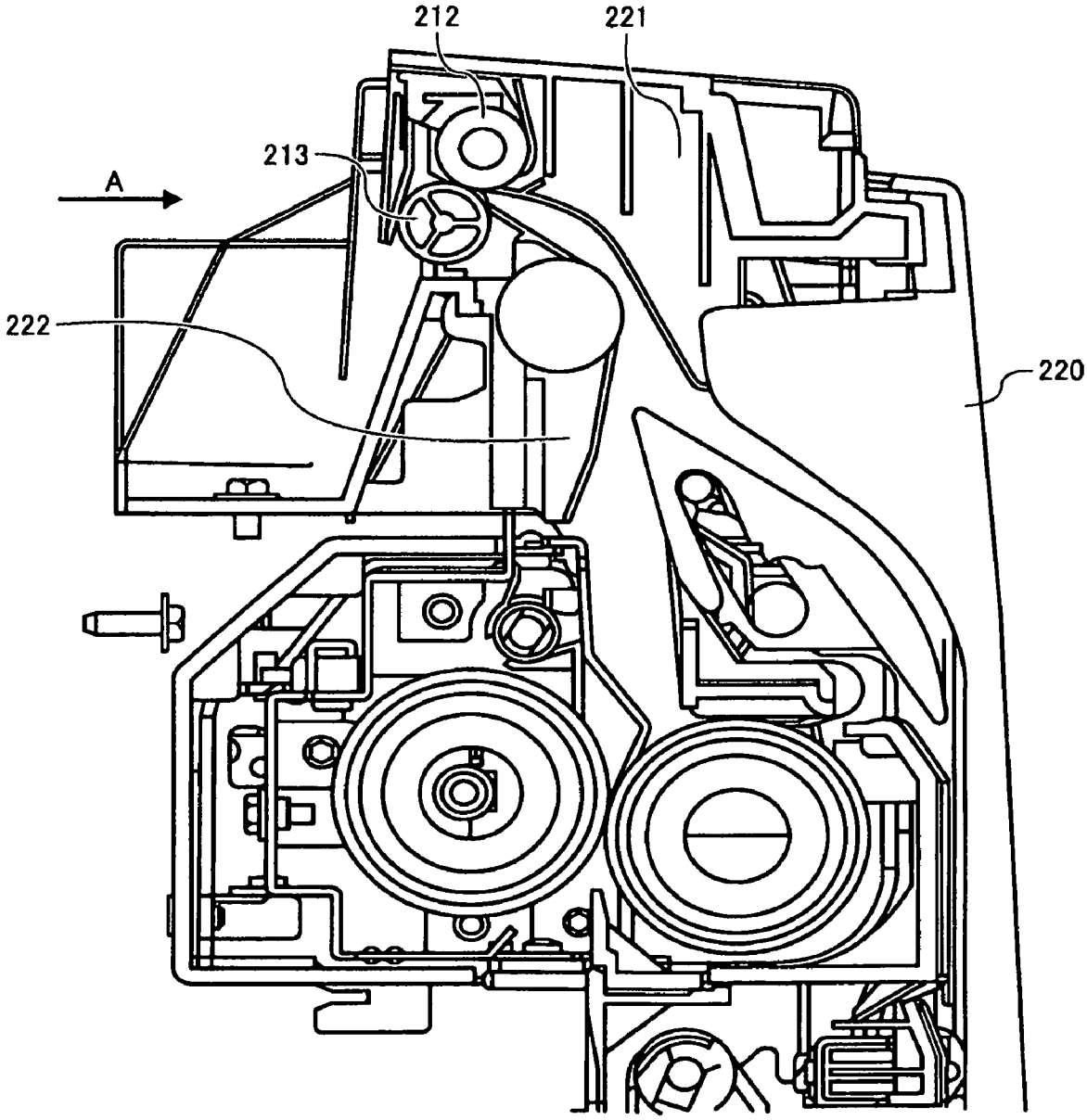
FIG. 15 is a side view of a sheet discharge unit of the image forming apparatus shown in FIG. 14.
Figure 16:
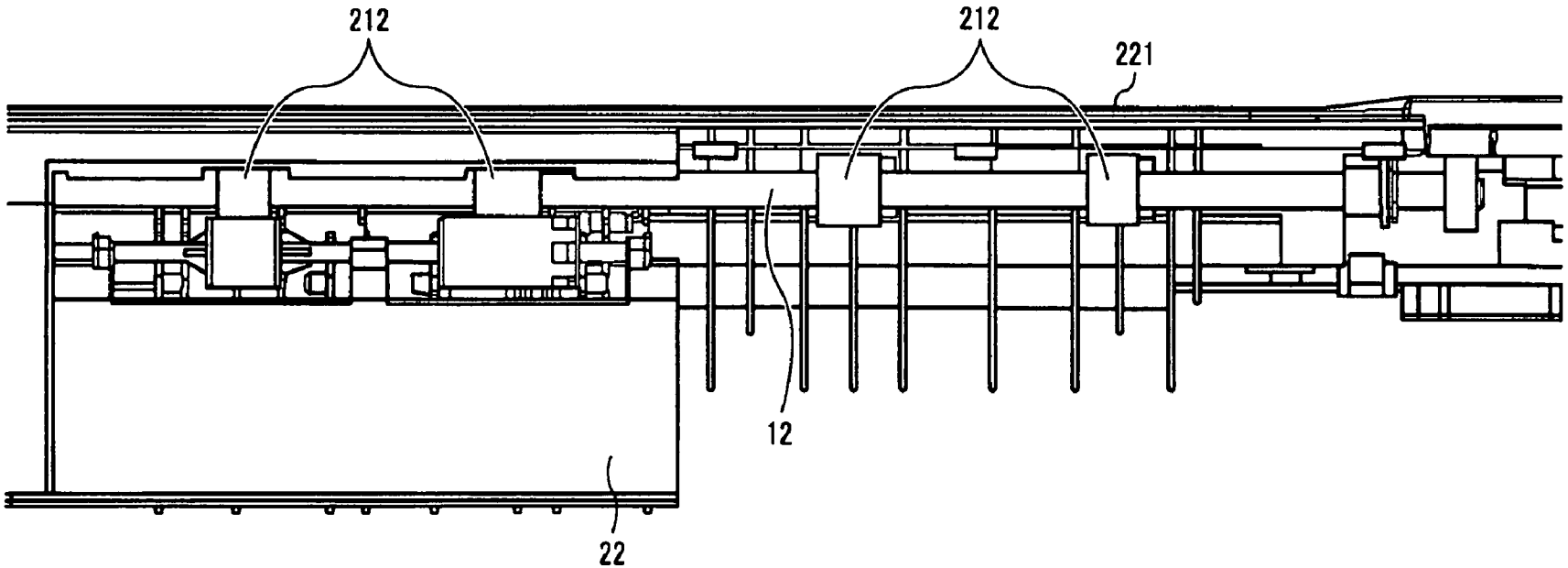
FIG. 16 is a schematic diagram of the sheet discharge unit viewed in a direction of A in FIG. 15.
Figure 17:
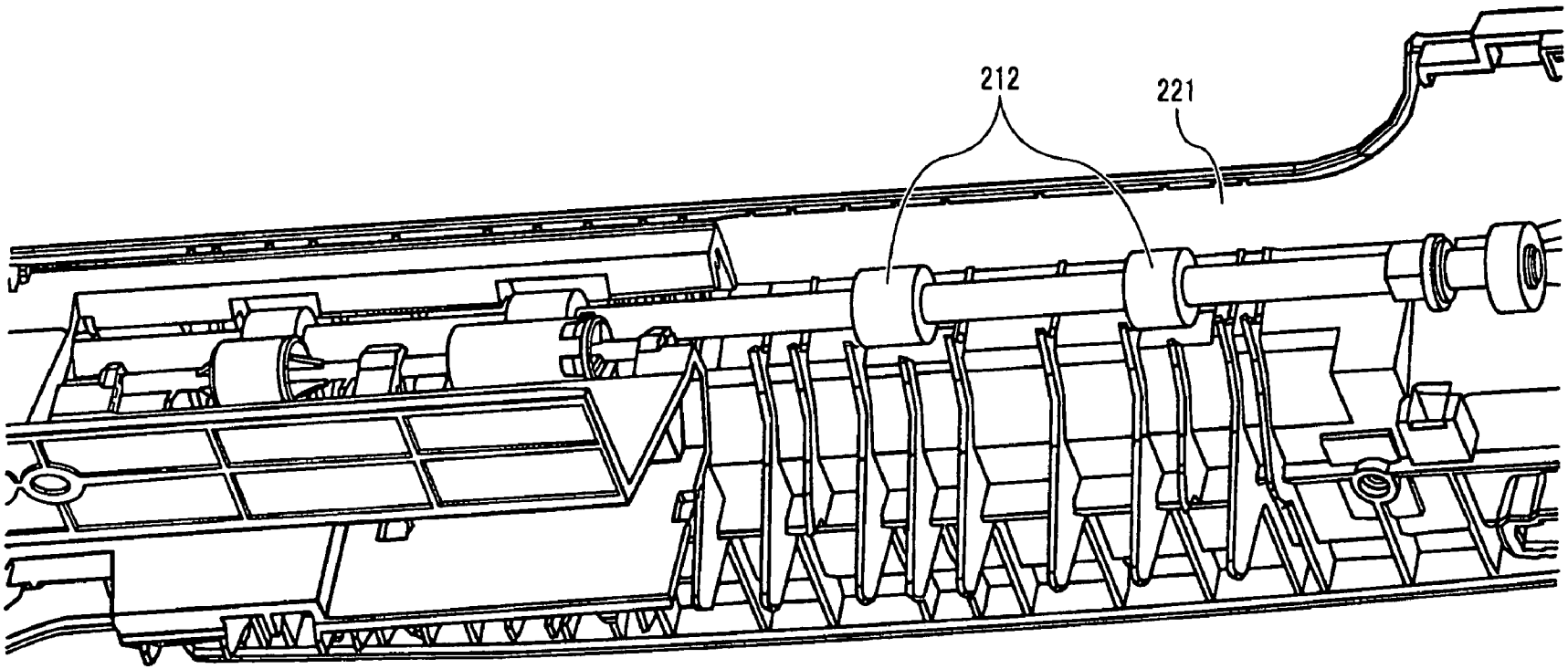
FIG. 17 is a perspective view of the sheet discharge unit shown in FIG. 15.
Figure 18:
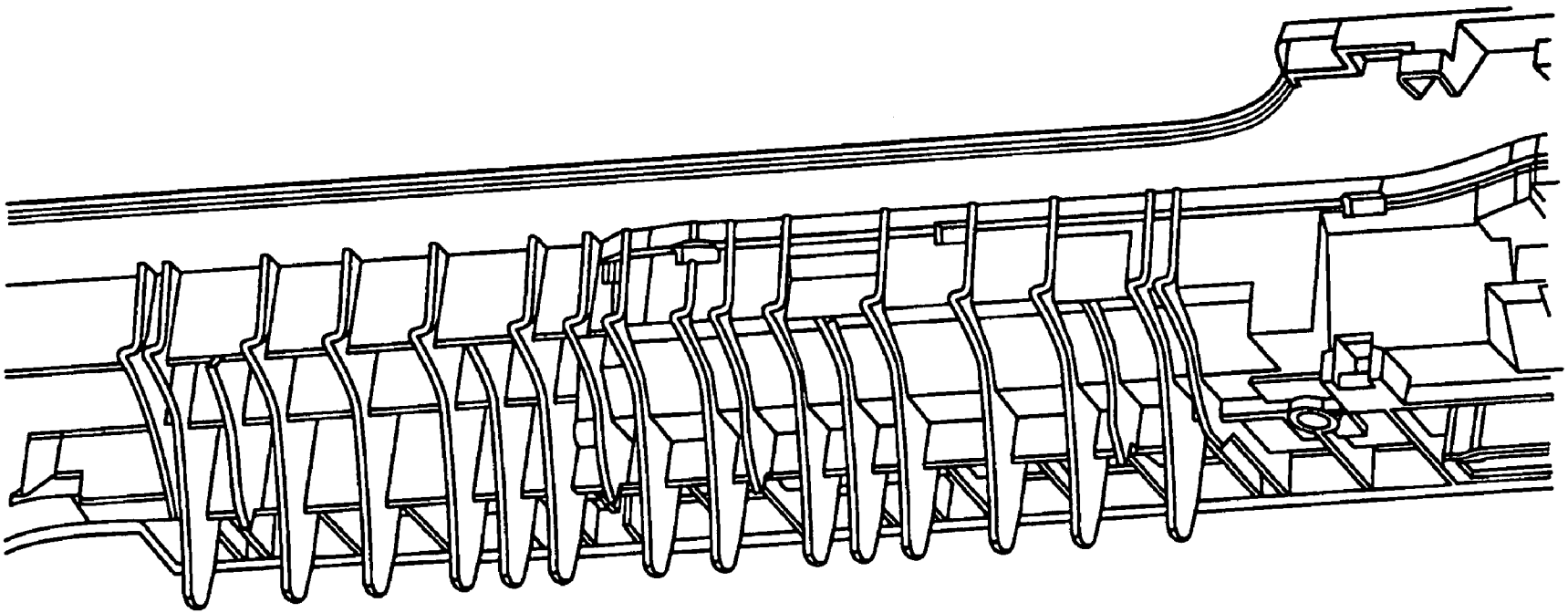
FIG. 18 is a perspective view of an upper guide of the image forming apparatus shown in FIG. 14.
Figure 19:
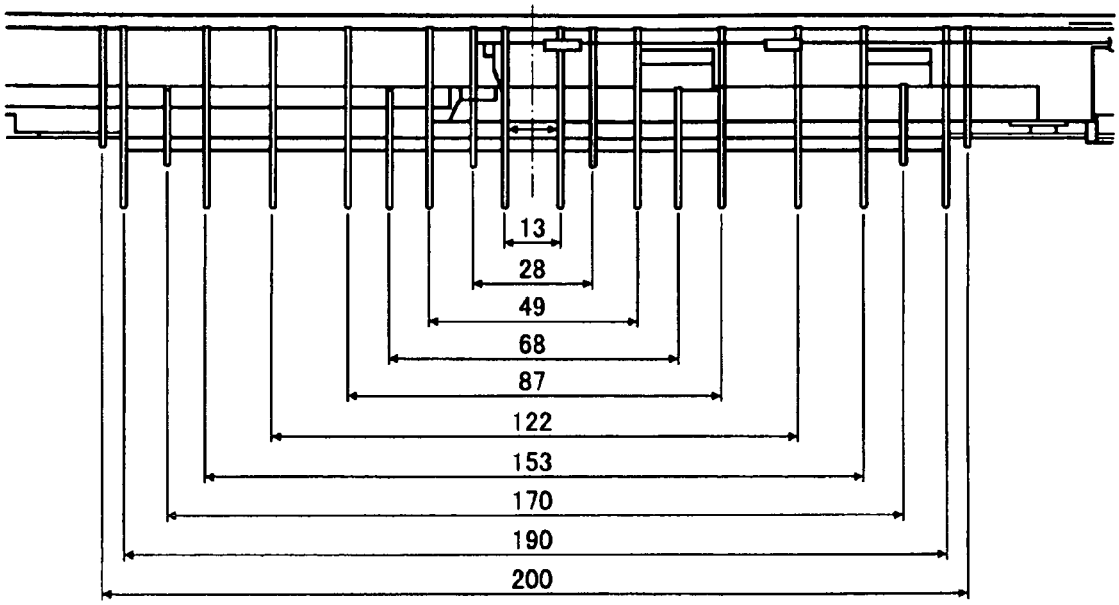
FIG. 19 is a schematic diagram for explaining a rib arrangement of the upper guide shown in FIG. 18.
Figure 20:
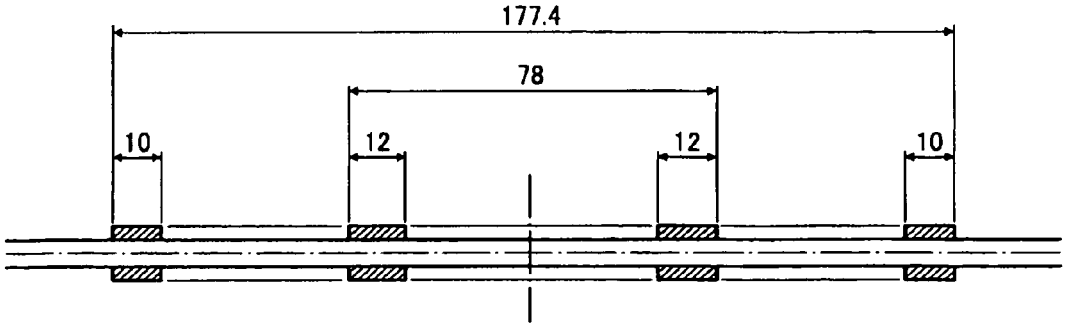
FIG. 20 is a schematic diagram for explaining a roller arrangement according to the third embodiment.

FIG. 15 is an enlarged side view of a sheet discharge unit shown in FIG. 14. FIG. 16 is a schematic diagram of the sheet discharge unit viewed in a direction of an arrow A in FIG. 15 (a lower guide 222 is cut away at the center, and reference numeral 12 represents an axis of rotation of the sheet discharge rollers 212). FIG. 17 is a perspective view of the sheet discharge unit. FIG. 18 is a perspective view of an upper guide 221. FIG. 19 is a schematic diagram for explaining a rib arrangement of the upper guide 221. FIG. 20 is a schematic diagram for explaining a roller arrangement.

By forming the paper feed rib in the upper guide 221 with dimensions shown in FIG. 19 and by forming a feeding path in combination with a roller shown in FIG. 20, a stable feeding performance can be obtained.

Specifically, when a sheet feeding path is provided inside the apparatus, a feeding unit that feeds a sheet along the path and a guide member that guides the sheet are provided, and a portion of a guide member that guides the sheet is formed in a rib shape parallel to the feeding direction, arrangement of the rib, the feed unit can be as follows.

A: Arrangement of the ribs is symmetrical to the center of a sheet to be fed and an interval between the adjacent ribs is 20 millimeters or less.

B: Arrangement of the ribs is symmetrical to the center of a sheet to be fed and an interval between the adjacent ribs is 15 millimeters or less within a range of 50 millimeters from the feeding center side.

C: A feeding unit is a roller in which cylindrical rubber with a diameter larger than a shaft is provided in plural in the axial direction with respect to the shaft, and the ribs are arranged one or more on the upstream side in the feeding direction of the rubber portion and one within a 5-millimeter range from the end face on the rubber feeding center side.

D: The feeding unit is a roller in which cylindrical rubber with a diameter larger than a shaft is provided in plural in the axial direction with respect to the shaft, and the ribs are arranged symmetrically with respect to the center of the sheet to be fed and the rubber is located between the third and fifth ribs from the center.

E: The feeding unit is a roller in which cylindrical rubber with a diameter larger than a shaft is provided in plural in the axial direction with respect to the shaft, and the ribs are arranged symmetrically with respect to the center of the sheet to be fed and the rubber is located between the seventh and ninth ribs from the center.

F: The feeding unit is a roller in which cylindrical rubber with a diameter larger than a shaft is provided in plural in the axial direction with respect to the shaft, and the ribs are arranged symmetrically with respect to the center of the sheet to be fed and the rubber is provided on extension of the fourth rib from the center.

G: The feeding unit is a roller in which cylindrical rubber with a diameter larger than a shaft is provided in plural in the axial direction with respect to the shaft, and the ribs are arranged symmetrically with respect to the center of the sheet to be fed and the rubber is provided on extension of the eighth rib from the center.

H: The feeding unit is a roller in which cylindrical rubber with a diameter larger than a shaft is provided in plural in the axial direction with respect to the shaft, and the ribs are arranged symmetrically with respect to the center of the sheet to be fed and a distance from the center to the eighth rib is twice or more of a distance from the center to the fourth rib.

I: The ribs are arranged symmetrically with respect to the center of the sheet to be fed, and the number of ribs is twenty.

J: The ribs are arranged symmetrically with respect to the center of the sheet to be fed, and the number of ribs is twenty.

K: The ribs are arranged symmetrically with respect to the center of the sheet to be fed, and the rib is not provided at the center.

L: The ribs are arranged symmetrically with respect to the center of the sheet to be fed, and a distance from the fifth rib to the tenth rib is larger than a distance from the center to the fifth rib.

The above embodiments are examples of embodiments of the present invention. The present invention is not limited to them and various modifications are applicable.

According to an aspect of the present invention, in a sheet feed device, it is possible to prevent a situation where a sheet conveyed from a feed roller group and a second roller group toward a sheet catch tray is not overlapped or rubbed with a sheet discharged from a feed roller group and a first roller group thereby causing damage or stain on an image on the sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A feeding device, comprising:

a feed roller group including at least two feed rollers rotatable around an axis perpendicular to a sheet feeding direction;

a first roller group including at least two first rollers rotatable along with the feed rollers, and operative to convey the sheet with the feed roller to a first direction; and a second roller group including at least two second rollers rotatable along with the feed rollers, and operative to convey the sheet with the feed rollers to a second direction opposite to the first direction, wherein at least one of the first rollers includes a first asymmetric roller having a first contact region that is in contact with the feed roller and a first noncontact region that is not in contact with the feed roller, the first noncontact region being arranged at an end of the first roller in a first axial direction of a rotating shaft of the feed rollers, at least one of the second rollers includes a second asymmetric roller having a second contact region that is in contact with the feed roller and a second noncontact region that is not in contact with the feed roller, the second noncontact region being arranged at an end of the second roller in a second axial direction of the rotating shaft of the feed rollers, the first asymmetric roller includes a first large-diameter portion provided on the first noncontact region and having a diameter larger than a diameter of a first small-diameter portion provided on the first contact portion, the first large-diameter portion being arranged relatively toward a center position of the sheet along the rotating shaft; and the second asymmetric roller includes a second large-diameter portion provided on the second noncontact region and having a diameter larger than a diameter of a second small-diameter portion provided on the second contact portion, the second large-diameter portion being arranged relatively away from the center position of the sheet along the rotating shaft.

2. A feeding device, comprising:

a feed roller group including at least two feed rollers rotatable around an axis perpendicular to a sheet feeding direction;

a first roller group including at least two first rollers rotatable along with the feed rollers, and operative to convey the sheet with the feed roller to a first direction; and a second roller group including at least two second rollers rotatable along with the feed rollers, and operative to convey the sheet with the feed rollers to a second direction opposite to the first direction, wherein at least one of the first rollers includes a first asymmetric roller having a first contact region that is in contact with the feed roller and a first noncontact region that is not in contact with the feed roller, the first noncontact region being arranged at an end of the first roller in an axial direction of a rotating shaft of the feed rollers, at least one of the second rollers includes a second asymmetric roller having a second contact region that is in contact with the feed roller and a second noncontact region that is not in contact with the feed roller, the second noncontact region being arranged at an end of the second roller in the axial direction of the rotating shaft of the feed rollers, the first asymmetric roller includes a first large-diameter portion provided on the first noncontact region and having a diameter larger than a diameter of a first small-diameter portion provided on the first contact portion, the second asymmetric roller includes a second large-diameter portion provided on the second noncontact region and having a diameter larger than a diameter of a second small-diameter portion provided on the second contact portion, and the first large-diameter portion and the second large-diameter portion are arranged at different positions in the axial direction of the rotating shaft of the feed rollers.

3. An image forming apparatus, comprising:

a feeding device including:

a feed roller group including at least two feed rollers rotatable around an axis perpendicular to a sheet feeding direction;

a first roller group including at least two first rollers rotatable along with the feed rollers, and operative to convey the sheet with the feed roller to a first direction; and a second roller group including at least two second rollers rotatable along with the feed rollers, and operative to convey the sheet with the feed rollers to a second direction opposite to the first direction, wherein at least one of the first rollers includes a first asymmetric roller having a first contact region that is in contact with the feed roller and a first noncontact region that is not in contact with the feed roller, the first noncontact region being arranged at an end of the first roller in a first axial direction of a rotating shaft of the feed rollers, at least one of the second rollers includes a second asymmetric roller having a second contact region that is in contact with the feed roller and a second noncontact region that is not in contact with the feed roller, the second noncontact region being arranged at an end of the second roller in a second axial direction of the rotating shaft of the feed rollers, the first asymmetric roller includes a first large-diameter portion provided on the first noncontact region and having a diameter larger than a diameter of a first small-diameter portion provided on the first contact portion, the first large-diameter portion being arranged relatively toward a center position of the sheet along the rotating shaft; and the second asymmetric roller includes a second large-diameter portion provided on the second noncontact region and having a diameter larger than a diameter of a second small-diameter portion provided on the second contact portion, the second large-diameter portion being arranged relatively away from the center position of the sheet along the rotating shaft.

4. An image forming apparatus, comprising:

a feeding device including:

a feed roller group including at least two feed rollers rotatable around an axis perpendicular to a sheet feeding direction;

a first roller group including at least two first rollers rotatable along with the feed rollers, and operative to convey the sheet with the feed roller to a first direction; and a second roller group including at least two second rollers rotatable along with the feed rollers, and operative to convey the sheet with the feed rollers to a second direction opposite to the first direction, wherein at least one of the first rollers includes a first asymmetric roller having a first contact region that is in contact with the feed roller and a first noncontact region that is not in contact with the feed roller, the first noncontact region being arranged at an end of the first roller in an axial direction of a rotating shaft of the feed rollers, at least one of the second rollers includes a second asymmetric roller having a second contact region that is in contact with the feed roller and a second noncontact region that is not in contact with the feed roller, the second noncontact region being arranged at an end of the second roller in the axial direction of the rotating shaft of the feed rollers, the first asymmetric roller includes a first large-diameter portion provided on the first noncontact region and having a diameter larger than a diameter of a first small-diameter portion provided on the first contact portion, the second asymmetric roller includes a second large-diameter portion provided on the second noncontact region and having a diameter larger than a diameter of a second small-diameter portion provided on the second contact portion, and the first large-diameter portion and the second large-diameter portion are arranged at different positions in the axial direction of the rotating shaft of the feed rollers.

* * * * *